United States Patent [19]

Mitchell et al.

[11] Patent Number: 4,828,291

[45] Date of Patent: May 9, 1989

[54] FLUTED SAFETY JOINT APPARATUS FOR USE IN CASED OIL AND GAS WELLS

[75] Inventors: Art Mitchell, Baytown; Mark T. Mitchell, Highlands, both of Tex.

[73] Assignee: Mitchell Well Service, Inc., Highlands, Tex.

[21] Appl. No.: 101,806

[22] Filed: Sep. 28, 1987

[51] Int. Cl.[4] ..... F16L 35/00

[52] U.S. Cl. ..... 285/39; 285/133.2; 285/142; 166/278

[58] Field of Search ..... 285/133.2, 140, 141, 285/142, 143, 39; 166/202, 278

[56] References Cited

U.S. PATENT DOCUMENTS

| | | | |
|---|---|---|---|
| 1,555,206 | 9/1925 | Hill | 285/143 X |
| 2,346,060 | 4/1944 | Yeatman | 285/142 X |
| 3,335,799 | 8/1967 | Miller | 285/142 X |
| 4,012,061 | 3/1977 | Olson | 285/133.2 |
| 4,308,918 | 1/1982 | Strickland | 166/202 |

*Primary Examiner*—Dave W. Arola

*Attorney, Agent, or Firm*—Pravel, Gambrell, Hewitt, Kimball & Krieger

[57] ABSTRACT

A downhole oil well fluted safety joint for use with a production string in cased hole provides an elongated tubular body having an internal open-ended flow bore and a plurality of radially spaced apart flutes extending from the bottom of the tool bore outer surface. The flutes provide spaces therebetween that allow fluid to circulate in the casing externally of the tool body above and below the fluted portions so that gravel can be pumped past the flutes, for example, to pack a screen and liner which is run below the tool body in typical installations. The tool is used, for example, to guide wire line or wash pipe inside a screen liner in order to check for fill and to prevent the wire line or wash pipe from inadvertently traveling on the outside of the tool body and thus, beside instead of inside the screen liner. The tool body includes an uninterrupted, generally uniform outer cylindrical surface that extends upwardly from the fluted portions a distance above the fluted portions so that the tool body can be retrieved with a common releasing tool, for example, or with a standard overshot. Further, the extended uninterrupted outer surface of the tool body provides a surface that allows a liner packer with an internal lead seal to be set between the tool body exterior surface and the casing for the purpose of controlling bottom hole pressure.

7 Claims, 2 Drawing Sheets

FLUTED SAFETY JOINT APPARATUS FOR USE IN CASED OIL AND GAS WELLS

BACKGROUND OF THE INVENTION

1. Field of the Invention

The present invention relates to down hole oil and gas well tools, and more particularly to an improved easily removable fluted safety joint for use in cased hole applications wherein wire line or wash pipe is to be guided into a screen and liner as part of washing out the liner, sand control, or the like.

2. General Background

It is common to line producing oil and gas wells with a casing which is simply a long string of connected sections of pipe, thus providing a hollow casing bore. The casing bore is occupied by a production string that extends down into the bore. It is known to run a number of tools known as down hole tools into the cased hole and upon such a production string to accomplish numerous tasks related to a cleaning of, servicing of or operation of the well.

There is presently available a commercial device that comprises a fluted body that can be attached atop a screen and liner for guiding a wire line or wash pipe inside the screen liner. One such fluted device is commercially sold by Texas Iron Works. The prior art devices, however, suffer because retrieval of the screen and liner is difficult or impossible. The user must often mill the fluted tool in order to retrieve the screen which is an expensive and time consuming procedure. These prior art devices cannot be retrieved by using a standard overshot or a common releasing tool. Further, the prior art devices do not provide any means for allowing a screen liner packer to be set in position on the device in order to control bottom hole pressure.

SUMMARY OF THE PRESENT INVENTION

The present invention solves these prior art problems and shortcomings in a simple straightforward yet efficient manner by providing a down hole oil well fluted safety joint for use with a production string in casing. The apparatus includes an elongated tubular body having an internal open ended flow bore. A plurality of radially spaced apart fluted portions extend from the tool body outer surface and are positioned at the lower end portion of the tool body. A plurality of spaces are provided between the fluted portions that allow fluid to circulate in the casing externally of the tool body above and below the fluted portion so that, for example, gravel can be packed around the screen and liner by pumping past the fluted portions at the passages. The tool body includes an uninterrupted generally uniform cylindrical outer surface that extends upwardly a distance from the fluted portions. A connection is provided at each end of the tool body for forming a connection between the tool body ends and the production string.

The fluted portions define an enlarged diameter portion of the tool at the lower end of the tool body which is adapted to engage the casing and space the tubular body inwardly and centrally in the casing.

In the preferred embodiment, the fluted portions have angular upstream faces that extend from a lower position of the tool body to a higher position at the periphery of the fluted portions.

In the preferred embodiment, the tubular body has a lower external threaded portion for attaching a screen and liner assembly to the lower end portion of the tool body.

In the preferred embodiment, the apparatus provides a connection at both the upper and lower end portions of the tool body in the form of threaded connections formed respectively at the end portions of the tool body for attaching the tool body to a production string.

In the preferred embodiment, the connections include an upper internal threaded connection within the bore of the tool body and a lower external threaded connection below the fluted portions.

In the method of the present invention, the apparatus can be used to service a liner and screen assembly in a cased hole oil well. A tubular body is positioned in the cased hole and the tubular body is spaced inwardly and centrally within the casing wall by a plurality of radially spaced flutes. The screen and liner assembly are positioned below the tubular body, and the liner can be gravel packed by transmitting gravel to the liner externally of the tubular body and between the spaced flutes. The liner can be washed internally to control sand, and bottom hole pressure can be controlled with a liner packer with lead seal positioned in the casing and externally on the tubular body.

BRIEF DESCRIPTION OF THE DRAWINGS

A better understanding of the invention can be had when the detailed description of a preferred embodiment set forth below is considered in conjunction with the drawings, in which.

DETAILED DESCRIPTION OF THE PREFERRED EMBODIMENT

Figure 1:
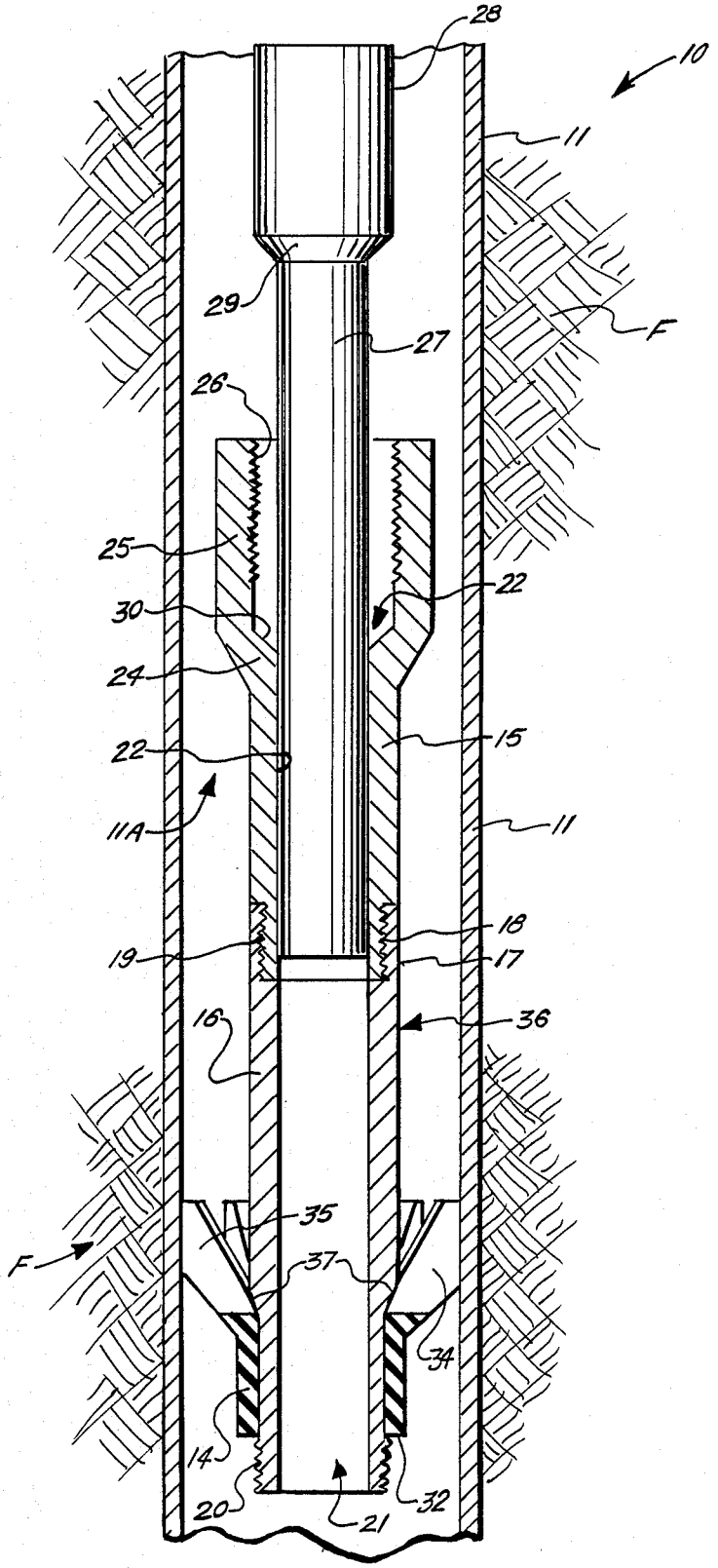
FIG. 1 is a sectional elevational view of the preferred embodiment of the apparatus of the present invention.
Figure 2:
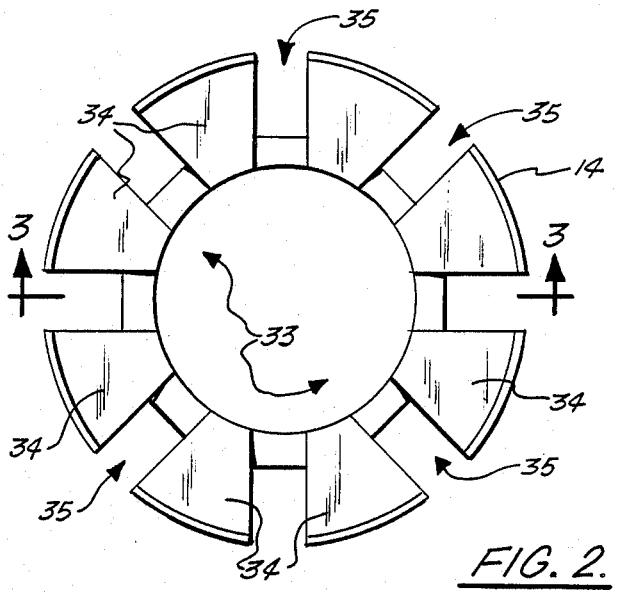
FIG. 2 is a top fragmentary view of the preferred embodiment of the apparatus of the present invention illustrating the fluted section.
Figure 3:
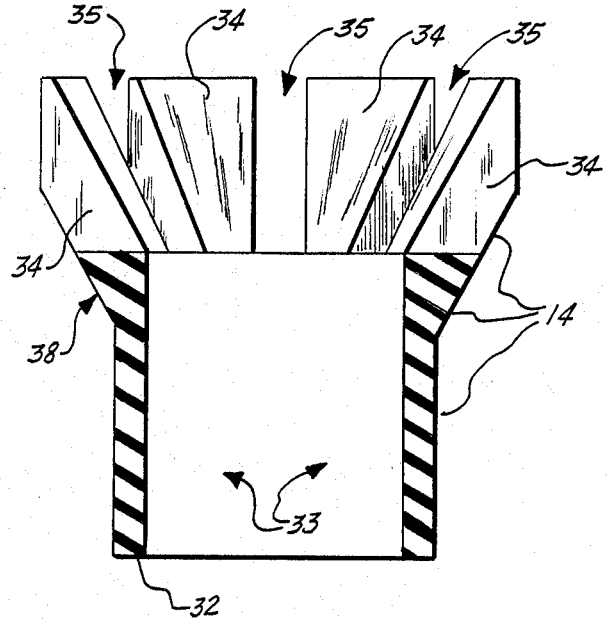
FIG. 3 is a side view taken along lines 3—3 of FIG. 2.

FIGS. 1–3 illustrate generally the preferred embodiment of the apparatus of the present invention designated generally by the numeral 10. In FIG. 1, the surrounding formation F is shown adjacent casing 11 which is for purposes of illustration a down hole oil well wherein a cased hole is shown.

Figure 4:
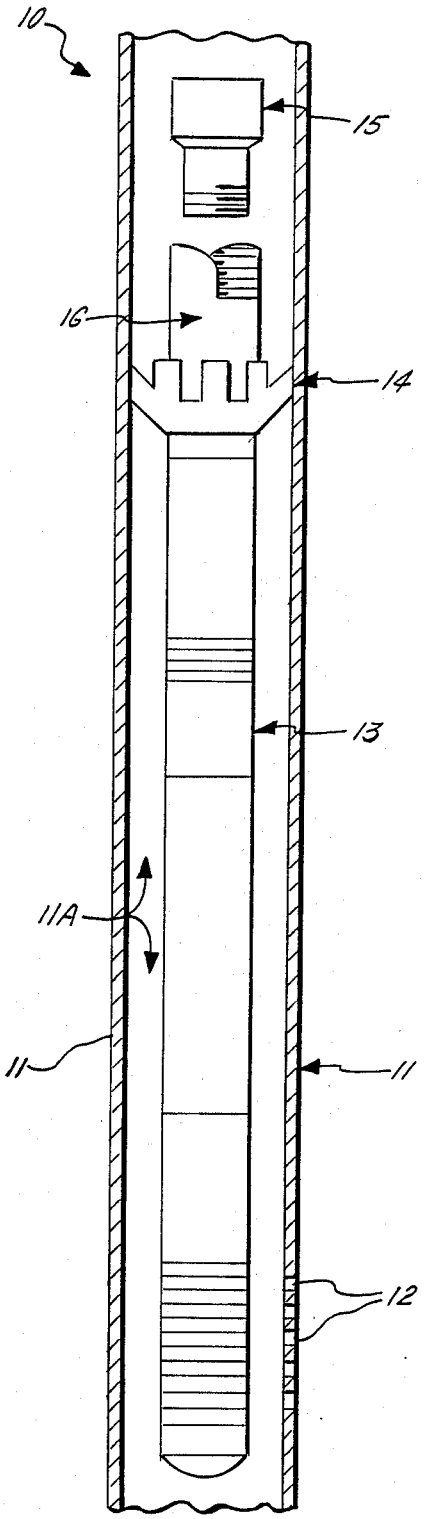
FIG. 4 is a schematic view illustrating use of the preferred embodiment of the apparatus of the present invention in combination with a screen and liner assembly.

Casing 11 is generally a commercially available commonly used cylindrical material and 11A designates the casing bore which is a hollow cylindrical bore defined by the inner walls of casing 11. As illustrated in FIG. 4, casing 11 communicates with the surrounding formation for receiving oil and gas into the casing bore 11A through a plurality of perforations 12 as is known in the art.

In the embodiment shown, a screen and liner assembly 13 which is commercially available are being supported by safety joint 10 which attaches at its upper end with a threaded connection, for example, to releasing tool 15. More particularly, the tool body 16 portion of safety joint 10 forms a threaded connection with releasing tool 15. Tool body 16 is preferably an elongated hollow cylindrical tool body having an open bore 21 through which fluids can flow. Fluted section 14 of safety joint 10 can be integrally attached to tool body 16 by welding, for example. Tool body 16 thus includes fluted section 14, and has upper and lower preferably threaded end portions including an upper portion 17 which attaches at threaded connection formed by female threads 18 on upper portion 17 and male threads 19 on the lower end portion of releasing tool 15. Thus, tool body 16 provides an uninterrupted outer cylindrical surface 36 that extends from the upper end portion 17 downwardly to fluted section 14. The uninterrupted surface 36 extends, for example, nine inches (9") above fluted section 14, a distance sufficiently above the fluted section 14 so that the tool body 16 can be gripped using a standard overshot, as commercially available, known tool in the art.

Tool body 16 provides a lower male threaded portion 20 which is adapted for attachment to a screen and liner assembly 13, as shown in FIG. 4.

Upper end portion 25 of releasing tool 15 includes an internally threaded section 26 and a beveled lower annular section 30. The annular beveled section 30 is adapted to register with the lower beveled surface 29 of upper end 28 of wash pipe 27 as the wash pipe is thrust downwardly through the bore 21 of tool body 16, a bore that is continuous with the internal bore 22 of releasing tool 15, and with the bore of screen and liner assembly 13. The wash pipe 27 can thus move downwardly until it is in a position to flush the screen and liner assembly of sand, for example.

The bore 22 of releasing tool 15 is defined by the internal wall of releasing tool 15 generally below annular beveled surface 30 that is defined by the transitional section 24 of releasing tool 15. Fluted portion 14 of tool body 16 includes a plurality of radially spaced flutes 34 which extend outwardly and upwardly, as best shown in FIGS. 1 and 3. Flutes 34 are radially spaced to provide flow passages 35 therebetween so that fluid can flow upwardly and downwardly past fluted portions 34. In this manner, gravel can travel in casing bore 11A below safety joint 10 and be packed around liner and screen assembly 13. The fluted section 14 of tool body 16 includes an internal bore 33 that is adapted to register upon tool body 16. Each fluted portion 34 includes an outer inclined surface 38, and an outer arcuate surface 39 that is adapted to register with the internal wall of casing 11, as shown in FIGS. 1–4. The lower end portion 32 of fluted section 14 terminates prior to male threaded section 20 of tool body 16. A transitional annular beveled shoulder section 37 of tool body 16 provides a registration position against which inner upwardly inclined surfaces 40 of fluted portions 34 rest upon assembly.

After assembly of fluted section 14 upon tool body 16, the fluted body can be permanently attached by welding, for example, to the tool body 16.

The tool body 16, fluted section 14, and releasing tool 15 can all be manufactured of any suitable structural material suitable for downhole oil well tool use such as stainless steel or the like.

The foregoing description of the invention is illustrative and explanatory thereof, and various changes in the size, shape and materials, as well as in the details of the illustrated construction may be made without departing from the spirit of the invention.

What is claimed as invention is:

1. A down hole tool for use in oil or gas wells for setting a screen liner in association with a gravel packing or erosion control operation fluted apparatus for use with a gravel pack at the lower end portion of a production string in casing comprising:

a. an elongated tubular body having an internal open ended flow bore;

b. a plurality of circumferentially spaced fluted portions extending radially from the tubular body and positioned at the lower end portion of the tubular body;

c. the tubular body including an uninterrupted, generally uniform outer surface extending upwardly from the fluted portions a distance sufficiently above the fluted portions so that:

(i) the tool body can be gripped with an overshot; and (ii) a lead seal can be attached thereto;

d. connection means positioned at ends of the tubular body flow bore at the upper and lower end portion thereof for forming a connection between the tubular body ends and the lower end of the production string; and e. the fluted portions defining an enlarged diameter portion at the lower end of the tubular body adapted to slideably engage the casing, spacing the tubular body inwardly of the casing as the tool body is positioned downhole in the casing at the lower end portion of the production string.

2. The apparatus of claim 1 wherein the fluted portions have angular upstream faces that extend from a lower position at the tubular body to a higher position at their periphery.

3. The apparatus of claim 1 wherein the connection means includes a lower, external threaded portion of the tubular body for attaching a screen and liner to the lower end portion of the tubular body.

4. The apparatus of claim 1 wherein the connection means comprises upper and lower threaded connections formed respectively at the upper and lower end portions of the tubular body.

5. The apparatus of claim 4 wherein the connection means includes an upper internal threaded connection in the bore and a lower external threaded connection below the fluted portion.

6. A method of servicing liner and screen in a cased hole oil well comprising the steps of:

a. positioning a tubular body in the cased hole;

b. spacing the tubular body inwardly of the casing wall with a plurality of radially spaced flutes;

c. supporting a screen below the tubular body;

d. gravel packing the liner by transmitting the gravel to the liner externally of the tubular body and between the spaced flutes;

e. washing the liner internally to control sand; and f. controlling bottom hole pressure with a liner packer with lead seal positioned in the casing and externally on the tubular body.

7. A tool adapted for mounting to the lower end of a production string inside the casing of an oil or gas well for setting a screen liner in association with a gravel packing or other erosion control operation, comprising:

a. an elongated tubular body having an upper and a lower end and an internal open ended flow bore;

b. a fluted portion formed at the lower end of the tubular body, the fluted portion comprising a plurality of uniform radial extensions spaced circumferentially about the tubular body;

c. the tubular body having a cylindrical upper portion extending above the fluted portion to provide a means for smooth engagement by a retrieving or sealing tool;

d. connecting means formed at the upper and lower ends of the tubular body for connecting the tool to the production string from above and to a sub unit below; and e. wherein the fluted portion forms an enlarged diameter portion at the lower end of the tubular body having a diameter slightly less than the inside diameter of the adjacent well casing; the fluted portion permitting fluid circulation in the annular space between the tubular body and the casing, but preventing passage of equipment lowered from the wellhead.

* * * * *